US006244436B1

(12) United States Patent
Boriani et al.

(10) Patent No.: US 6,244,436 B1
(45) Date of Patent: Jun. 12, 2001

(54) BLANK MADE OF A WRAPPING MATERIAL FOR MAKING A RIGID PACKAGE WITH HINGED LID FOR AN ORDERED GROUP OF CIGARETTE PACKS AND THE RELATIVE PACKING METHOD

(75) Inventors: Silvano Boriani, Bologna; Alessandro Minarelli, Bazzano, both of (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 09/549,379

(22) Filed: Apr. 13, 2000

(30) Foreign Application Priority Data

Apr. 16, 1999 (IT) ..... BO99A0182

(51) Int. Cl.[7] ..... B65D 85/10

(52) U.S. Cl. ..... 206/268; 206/272; 206/273; 206/265; 229/160.1; 53/228

(58) Field of Search ..... 206/271, 273, 206/268, 265, 499; 229/160.1, 146; 53/228, 234, 225

(56) References Cited

U.S. PATENT DOCUMENTS

| | | | | |
|---|---|---|---|---|
| 3,752,308 | * | 8/1973 | Begenmann | 206/273 |
| 4,392,338 | * | 7/1983 | Fox | 53/462 |
| 5,113,638 | * | 5/1992 | Focke et al. | 53/462 |
| 5,143,213 | | 9/1992 | Moore et al. . | |
| 5,461,841 | * | 10/1995 | Spada et al. | 53/234 |
| 5,586,648 | * | 12/1996 | Focke et al. | 206/268 |
| 5,588,281 | | 12/1996 | Boriani et al. . | |

FOREIGN PATENT DOCUMENTS

| | | |
|---|---|---|
| 0 671 342 | 9/1995 | (EP) . |
| BO94A0096 | 3/1994 | (IT) . |
| BO97A0622 | 10/1997 | (IT) . |

* cited by examiner

*Primary Examiner*—Paul T. Sewell
*Assistant Examiner*—Troy Arnold
(74) *Attorney, Agent, or Firm*—Pillsbury Winthrop LLP

(57) ABSTRACT

A rigid package with hinged lid which holds a group of cigarette packs stacked flat against one another, parallel with the bottom of the package, along a stacking axis which is at a right angle to the longitudinal axes of the packs comprises a container and a lid, which are hinged together, and an inner frame which is partially inside the container; the package is made from a flat blank which is substantially rectangular and, in the direction of its longer longitudinal axis has a main portion designed to define the container and the lid, and a longitudinal end appendix designed to be folded over the main portion to define the inner frame; the appendix is substantially U-shaped and is hinged, with its arms, to two side panels of the blank which define the sides of the package and surrounds a longitudinal free end of the main portion; the free end consists of a panel designed to define the bottom of the package, and two side tabs and a longitudinal end tab defining respective flaps for closing the bottom; the group is fed at a right angle to its stacking axis and the axes of the packs towards a folding unit, to which the blank is fed parallel with its longitudinal axis and with the stacking axis, and which folds the blank around the group, by folding it about an axis at a right angle to both the stacking axis and the longitudinal axis.

22 Claims, 7 Drawing Sheets

BLANK MADE OF A WRAPPING MATERIAL FOR MAKING A RIGID PACKAGE WITH HINGED LID FOR AN ORDERED GROUP OF CIGARETTE PACKS AND THE RELATIVE PACKING METHOD

BACKGROUND OF THE INVENTION

The present invention relates to a blank made of a packaging material for making a rigid package with hinged lid for an ordered group of cigarette packs.

As is known, ordered groups of cigarette packs are often packaged in rigid packages of the type comprising a lower container and an upper lid, both cup-shaped, the lid being hinged along a rear edge of the container in such a way that it can turn between a position in which the container is open and a position in which it is closed.

Such packages normally have the shape of a substantially rectangular parallelepiped and comprise a top, base and back, defined by a continuous surface which is divided into two parts by a transversal hinge line, coinciding with the rear edge, which connects the lid to the container, a front panel defined by two separate portions which form the front surface of the container and, respectively, the front surface of the lid, and two sides, each defined by two separate portions constituting a side surface of the container and a side surface of the lid.

Rigid packages of the above-mentioned type also normally have an inner frame, which is partially inside the container, in contact with the inside of the front surface and the sides of the container. The portion of the inner frame which projects outside the container basically functions as a support and retaining element for the lid when the latter is in the closed position.

Rigid packages of the above-mentioned type are normally made in a cartoner of the known type using a given sequence of stages of folding a flat blank, made of cardboard or another similar material, about a ready-ordered group of cigarette packs, stacked according to a preferred stacking axis.

Moreover, the blanks used for such packages are usually of the type with incorporated inner frame, that is to say, the blanks have a first portion designed to define the container and lid, and a second portion which defines the inner frame.

mCartoners of the type described in U.S. Pat. No. 5,588,281 by the Applicant, whose content is introduced herein, are known, in which in particular each ready-ordered group of packs is fed into an arbor in a direction transversal to the longer longitudinal axes of the packs, together with a flat blank which is normally fed along a path P which lies on a plane transversal to the direction of feed of the group of packs to the arbor, towards a given zone at which the blank is positioned substantially in front of the arbor in such a way that it intercepts the group of packs moving towards the arbor.

The arbor has a lower surface which supports the group of packs. One panel on the blank is inserted between said surface and the packs and may correspond to one side of the rigid package.

The blank is of the type described in Italian patent number 1.273.832 and the application for a European patent number 95103274.7 by the Applicant, whose content is introduced herein and, for the purpose of clarity, said type of blank is illustrated in FIG. 1, or of the type described in Italian patent application number BO 97A000622 by the Applicant, whose content is introduced here and, for the purpose of clarity, this type of blank is illustrated in FIG. 2.

Both the blank illustrated in FIG. 1 and that illustrated in FIG. 2, have a longer longitudinal axis A along which, joined by prefolding lines B, there is a plurality of panels N designed to define, respectively, the front C, back D and sides E of the rigid package defining a carton S of the type described, for example, in the above-mentioned European patent application number 95103274.7 by the Applicant, whose content is introduced herein.

For the purpose of clarity, this type of carton is illustrated in FIG. 3.

These types of blanks, described above, also have an appendix F which extends transversally to the above-mentioned longitudinal axis A, along its own axis A' which is perpendicular to the axis A, and is designed to define the inner frame G. With reference to FIG. 3, the carton S thus obtained holds an ordered group of cigarette packs H arranged in two rows, each consisting of five packs lying next to one another, with the front V of one making contact with the back Z of the other and with their longer longitudinal axis X, with reference to FIGS. 1 and 2, perpendicular to the longitudinal axis A of the blank from which the carton S is obtained.

The packs H are, therefore, positioned in such a way that their bottom ends I and top ends T are parallel with the base M of the carton S.

It should be noticed that, for technical reasons linked to the special architecture and the position of the arbors in cartoners of the known type, the blanks described above are normally fed towards the arbor along a path P which extends parallel with the preferred pack stacking axis and, therefore, with reference to FIGS. 1 and 2, the blanks are set at an angle to their axis A which makes the path P substantially coincide with the longer longitudinal axis A of the blanks.

Marketing requirements necessitate the manufacture of cartons whose external dimensions are as directly proportional as possible to the external dimensions of a conventional rigid hinged-lid pack which is to be contained in the carton.

This characteristic is present, for example, in the carton described in U.S. Pat. No. 5,143,213, in which the group of packs consists of five packs H stacked in such a way that the front V of one is in contact with the back Z of the next or previous pack in the stack. The packs H are, therefore, arranged in the carton with the fronts V and backs Z parallel with the bottom and top of the carton. This type of pack H arrangement is, therefore, different to the pack arrangement in the carton illustrated in FIG. 3.

The type of carton described and illustrated in U.S. Pat. No. 5,143,213 is obtained by folding a blank, of the type illustrated for convenience in FIG. 4 which reproduces FIG. 1 of U.S. Pat. No. 5,143,213, in which for greater clarity a dashed line is used to illustrate a plurality of packs H stacked along a preferred stacking axis Y.

Along its longer longitudinal axis A, the blank has a plurality of panels N, joined by prefolding lines B, designed to define, respectively, the front C, back D and sides E of the rigid package defining a carton of the type described in U.S. Pat. No. 5,143,213. The blank also has an appendix F which extends along the longitudinal axis A and is designed to define the inner frame G whose U-shaped free edge L defining the portion of the inner frame G which projects from the container is parallel with the axis A.

As illustrated in FIG. 4, it is evident that, starting with such a blank, in order to obtain a carton which holds the packs H stacked along the axis Y with the fronts V and backs Z parallel with the bottom and top of the carton, each pack H must be oriented with its longer longitudinal axis X parallel with the longitudinal axis A of the blank and, therefore, parallel with the free edge L of the inner frame G.

It is also evident that the blank illustrated in FIG. 4, with its appendix F positioned on and extending along the axis A, is longer along the axis A than are the blanks illustrated in FIGS. 1 and 2.

With reference to the description of blank feed, the type of blank illustrated in FIG. 4 could be fed to the arbor in the cartoner of the type described above by feeding the blank along a feed path P and setting the blank at an angle to its longitudinal axis A in two different ways.

The first method involves feeding the blank angled as shown in FIG. 4, that is to say, with its longitudinal axis A perpendicular to the feed path P, which extends parallel with the preferred pack H stacking axis Y. In this case, there would be the evident problems with an excessive width, and radical modification of the folding devices on the arbor in the above-mentioned cartoner would be required. A second method involves feeding the blank angled with its longitudinal axis A parallel with the path P, that is to say, with the blank rotated 90° relative to the barycentric axis perpendicular to the plane in the figure, as illustrated by the dashed line in FIG. 4. This method would overcome the problem of the excessive width, but in addition to modification of the folding devices, the cartoner would have to be fitted with another device able to pick up the ready-ordered groups of packs and rotate them 90° about an axis perpendicular to the stacking axis Y, so that in the completed carton the packs are arranged with the fronts V and backs Z parallel with the bottom and top of the carton and with their longitudinal axes X parallel with the longitudinal axis A of the blank and, therefore, parallel with the free edge L of the inner frame G.

In addition to the above-mentioned disadvantages, the blank in FIG. 4 is relatively expensive, since quite a lot of wrapping material is required for its production.

The aim of the present invention is to provide a blank made of a wrapping material for making a rigid package with hinged lid for an ordered group of cigarette packs, which allows the obtainment of a package whose external dimensions are substantially directly proportional to the external dimensions of the packs which it contains, which can be used in a cartoner of the known type, described above, without necessitating substantial modifications to the machine, and which is also relatively economical.

SUMMARY OF THE INVENTION

Accordingly, the present invention provides a blank made of a wrapping material for making a rigid package with hinged lid for an ordered group of cigarette packs, the rigid package having a front, a back, two sides, a top and a bottom, and comprising a container and a lid, both cup-shaped and hinged together along respective rear edges, and an inner frame which is partially inside the container and fixed to a front surface and two sides of the container. The flat blank has a main portion designed to define the container and lid, and an appendix at one end which is substantially U-shaped and comprises two side arms and a transversal panel, designed to define the inner frame. The blank is characterized in that it is substantially rectangular, with a longer longitudinal axis and has, extending along the longitudinal axis, the above-mentioned main portion and appendix. The main portion comprises an end panel designed to define the back, a first intermediate panel designed to define the top, a central panel designed to define the front and two first side panels designed to define the sides. The appendix is hinged with the arms to the respective side panels and surrounds a longitudinal free end of the main portion. The free end comprises a second intermediate panel designed to define the bottom, two transversal side tabs and a longitudinal end tab designed to define respective flaps for closing the bottom.

The present invention also relates to a method for making a rigid package with hinged lid for an ordered group of cigarette packs.

Accordingly the present invention provides a method for making a rigid package with hinged lid for an ordered group of cigarette packs stacked along a given stacking axis, each pack having a substantially parallelepiped shape comprising two larger side surfaces, two smaller side surfaces and a longitudinal axis parallel with said surfaces, the packs being stacked flat, with their longitudinal axes parallel with one another and perpendicular to the stacking axis. The shape of the package is substantially that of a parallelepiped, defined by a front, a back, two sides, a top and bottom and comprising a container and a lid, both cup-shaped and hinged together along rear edges, and an inner frame which is partially inside the container and fixed to a front surface and two sides of the container. The package is made from a flat blank which has a main portion designed to define the container and lid, and a substantially U-shaped appendix comprising two side arms and a transversal panel designed to define the inner frame. The method comprises the stages of feeding the blank, with substantially rectangular shape and a larger longitudinal axis extending in the direction of the main portion and appendix, along a first given feed path and in a direction parallel with the longitudinal axis, and parallel with the pack stacking axis, towards a folding station; placing the blank in a given position between the group of packs and the folding station; the main portion comprising an end panel designed to define the back, a first intermediate panel designed to define the top, a central panel designed to define the front, and two side panels designed to define the sides. The appendix is hinged with the arms, which extend parallel with the longitudinal axis, to the side panels, and makes contact with the main portion from a position in which it surrounds a longitudinal free end of the main portion, the free end comprising a second intermediate panel designed to define the bottom, two transversal fourth side tabs and a fifth longitudinal end tab designed to respectively define the flaps for closing the bottom. In the given position, the appendix has the arms parallel with the stacking axis and the transversal panel is perpendicular to the stacking axis. There is also the stage of feeding the group of packs in a direction substantially at right angles to the stacking axis and with the smaller surfaces facing the blank; wrapping the blank around the group of packs, folding it about an axis at right angles to both the stacking axis and the longer longitudinal axis of the blank.

BRIEF DESCRIPTION OF THE DRAWINGS

The present invention is now described, by way of example only and without limiting the scope of its application, with reference to the accompanying drawings, in which.

DESCRIPTION OF THE PREFERRED EMBODIMENTS

Figure 1:
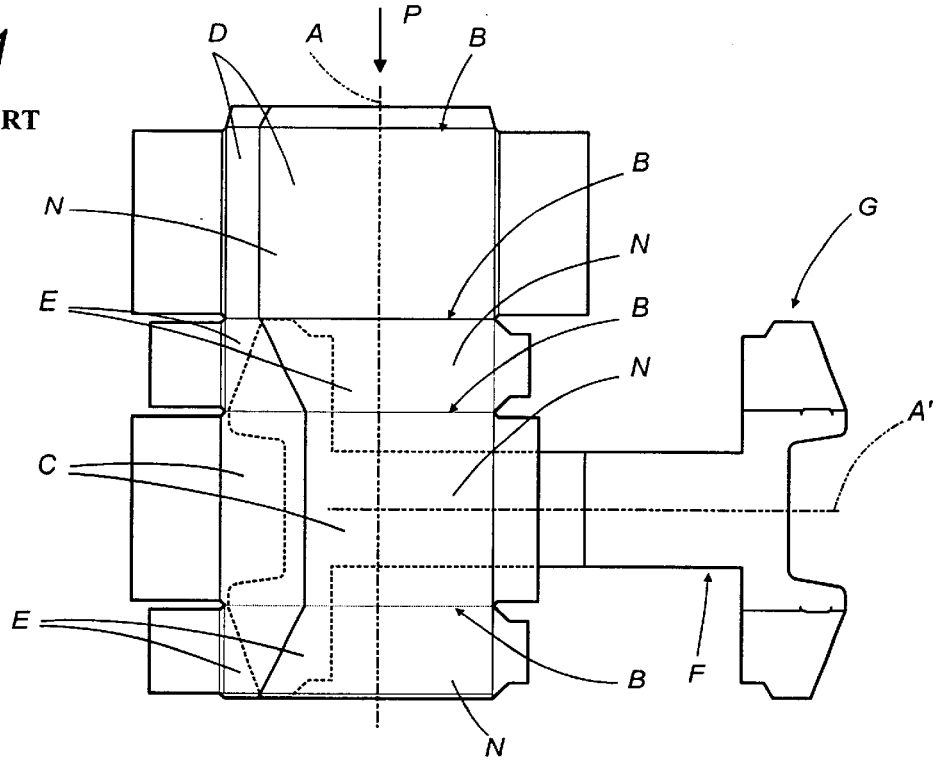
FIG.1 PRIOR ART
FIG. 1 is a view of a flat first blank with incorporated inner frame of the known type for making a rigid package with hinged lid.
Figure 2:
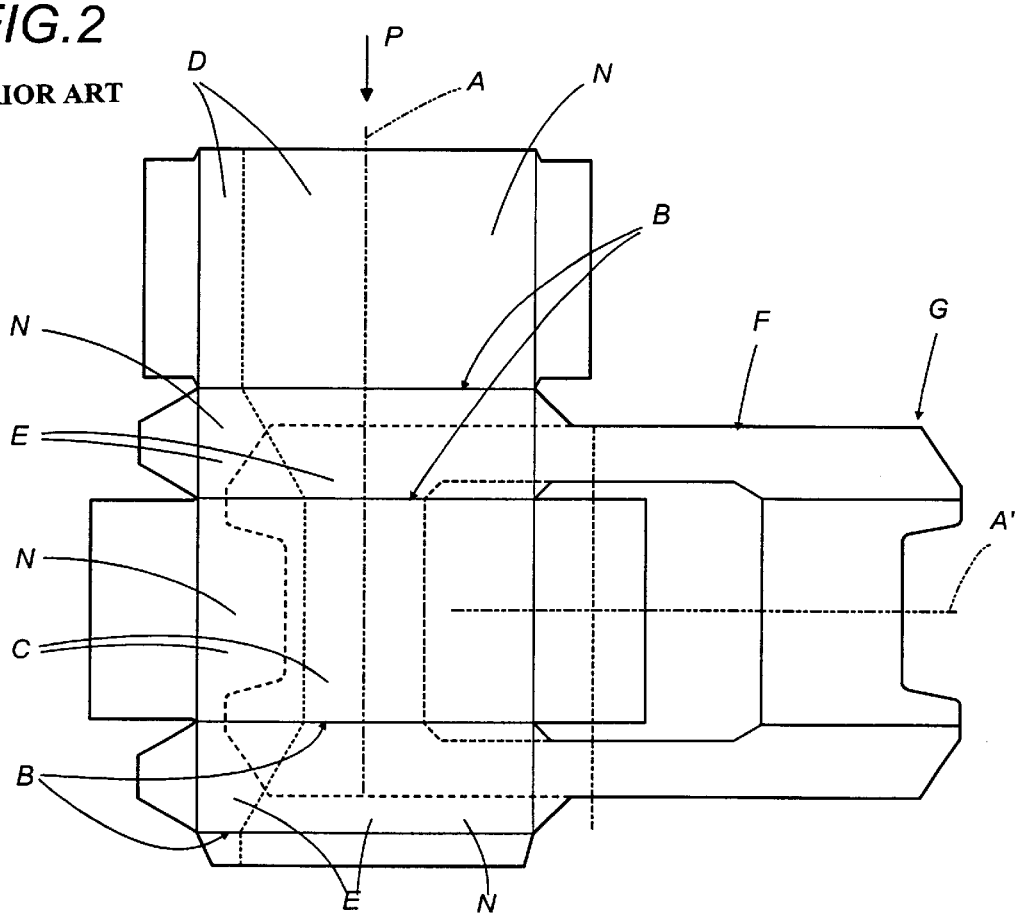
FIG.2 PRIOR ART
FIG. 2 is a view of a flat second blank with incorporated inner frame of the known type for making a rigid package with hinged lid.
Figure 3:
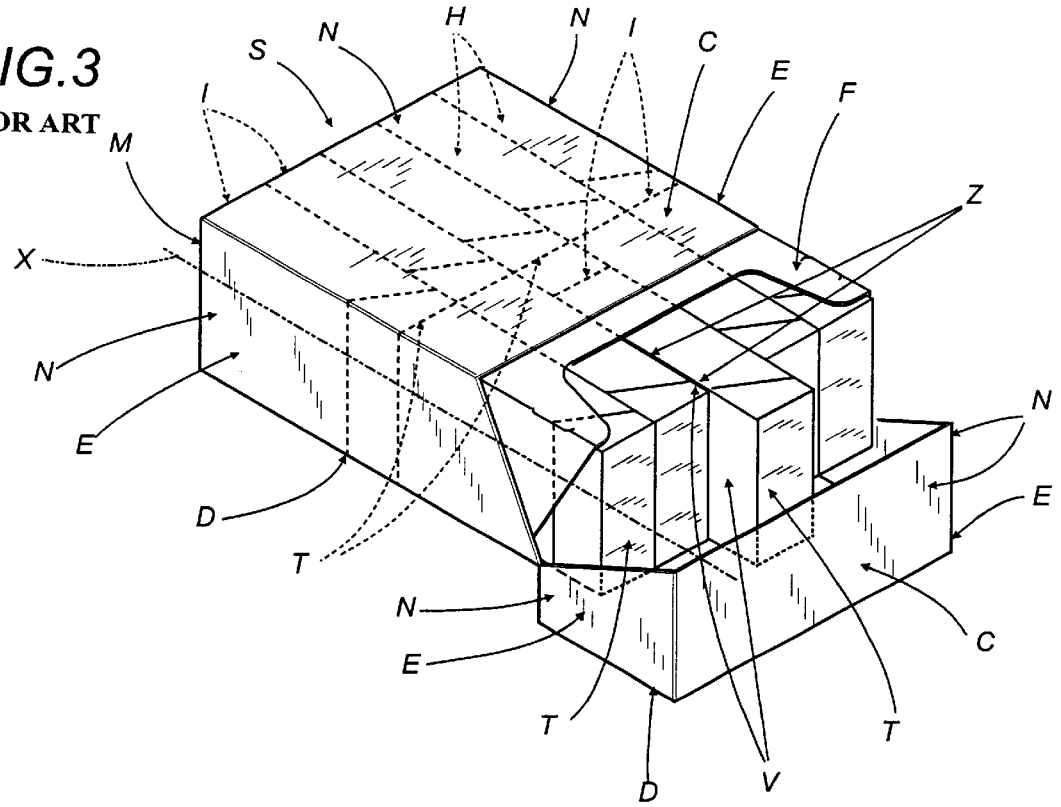
FIG.3 PRIOR ART
FIG. 3 illustrates a rigid package with hinged lid made from the blank illustrated in FIG. 1 or FIG. 2.
Figure 4:
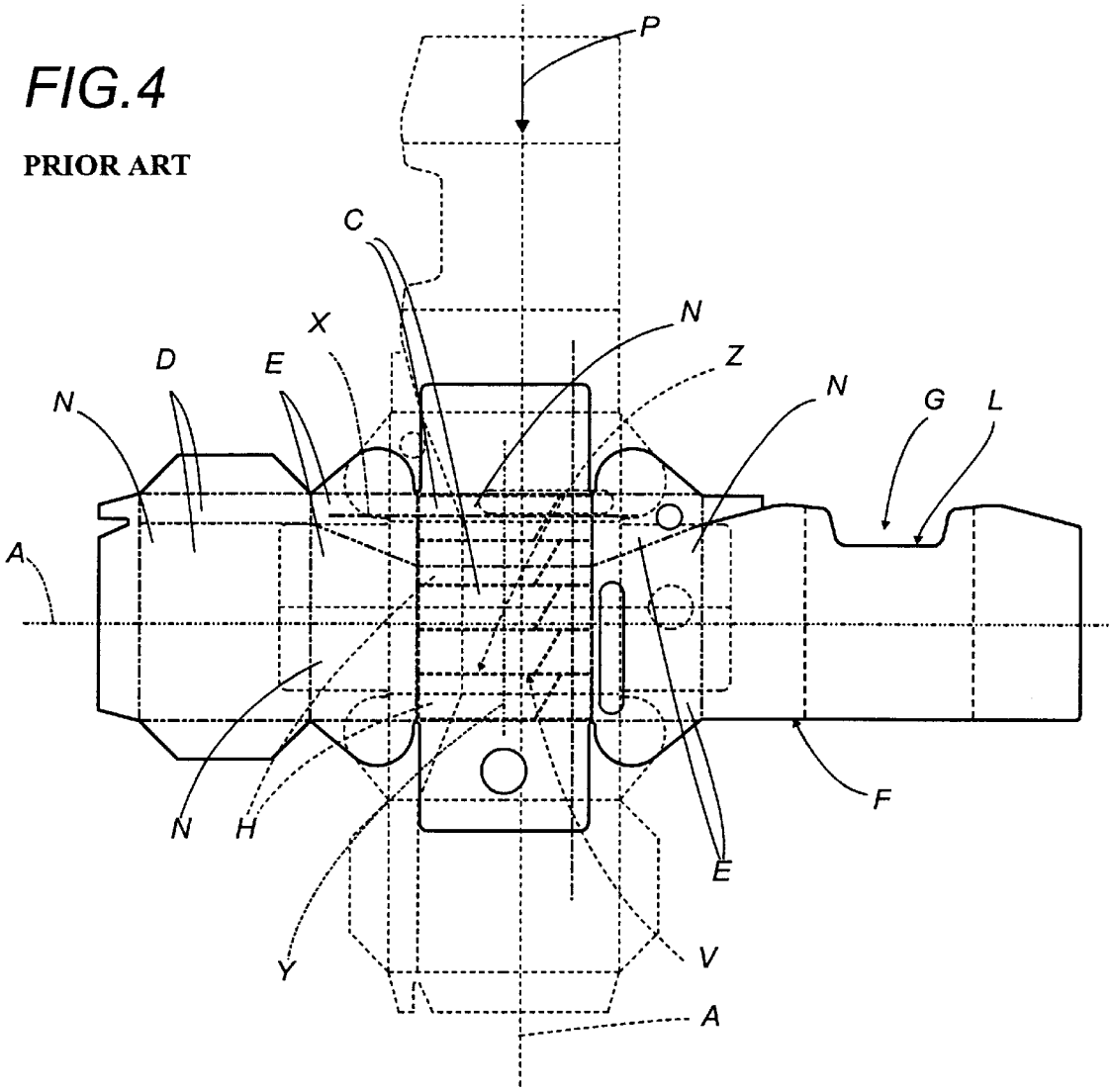
FIG.4 PRIOR ART
FIG. 4 is a view of a flat third blank with incorporated inner frame of the known type for making a rigid package with hinged lid.
Figure 5:
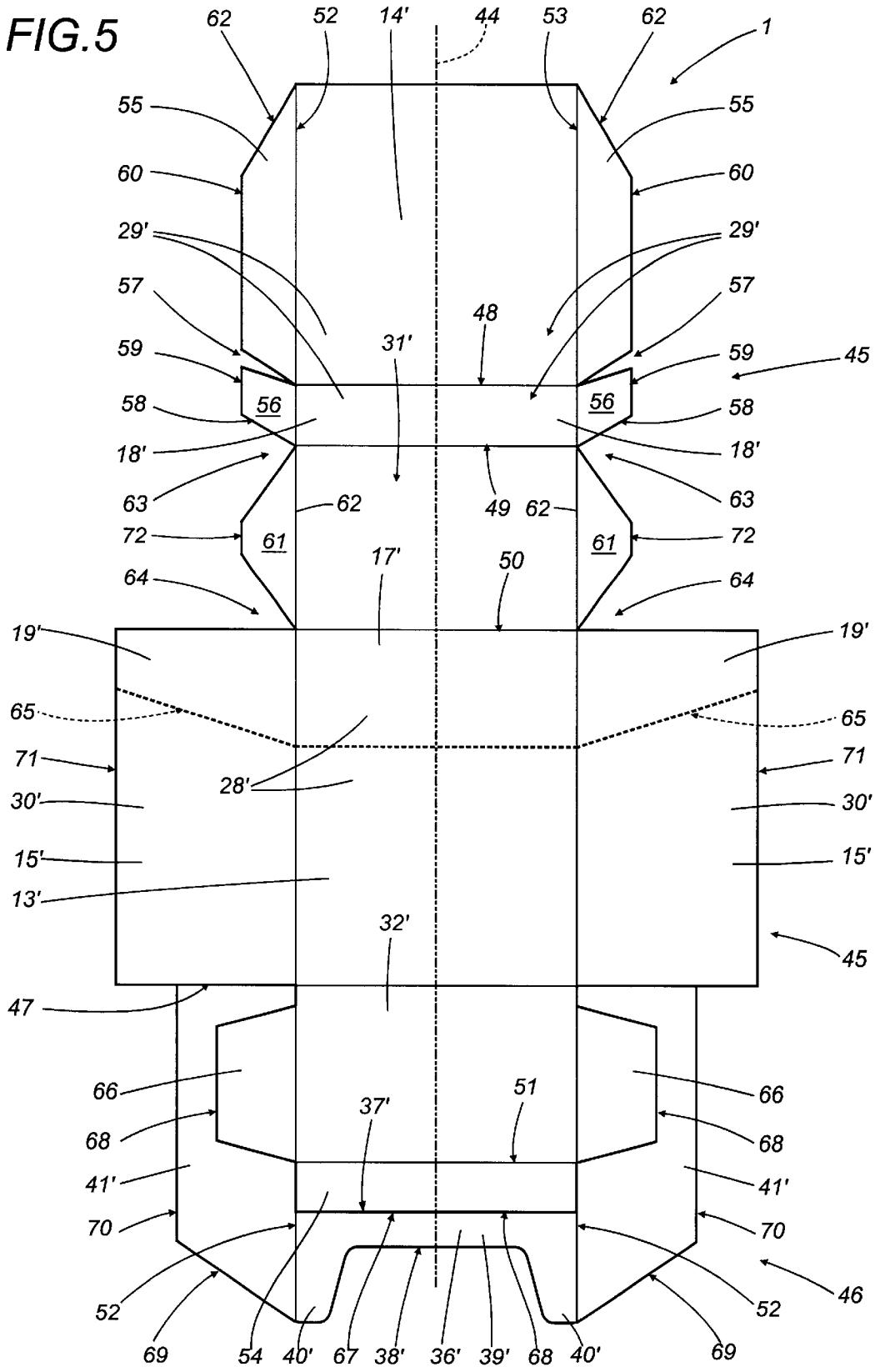
FIG. 5 is a view of a flat embodiment of the blank with incorporated inner frame made in accordance with the present invention.

With reference to FIG. 5, the numeral 1 indicates as a whole a flat blank obtained by shaping and punching a length (not illustrated) of a web of wrapping material, such as cardboard or a similar material (not illustrated).

Figure 6:
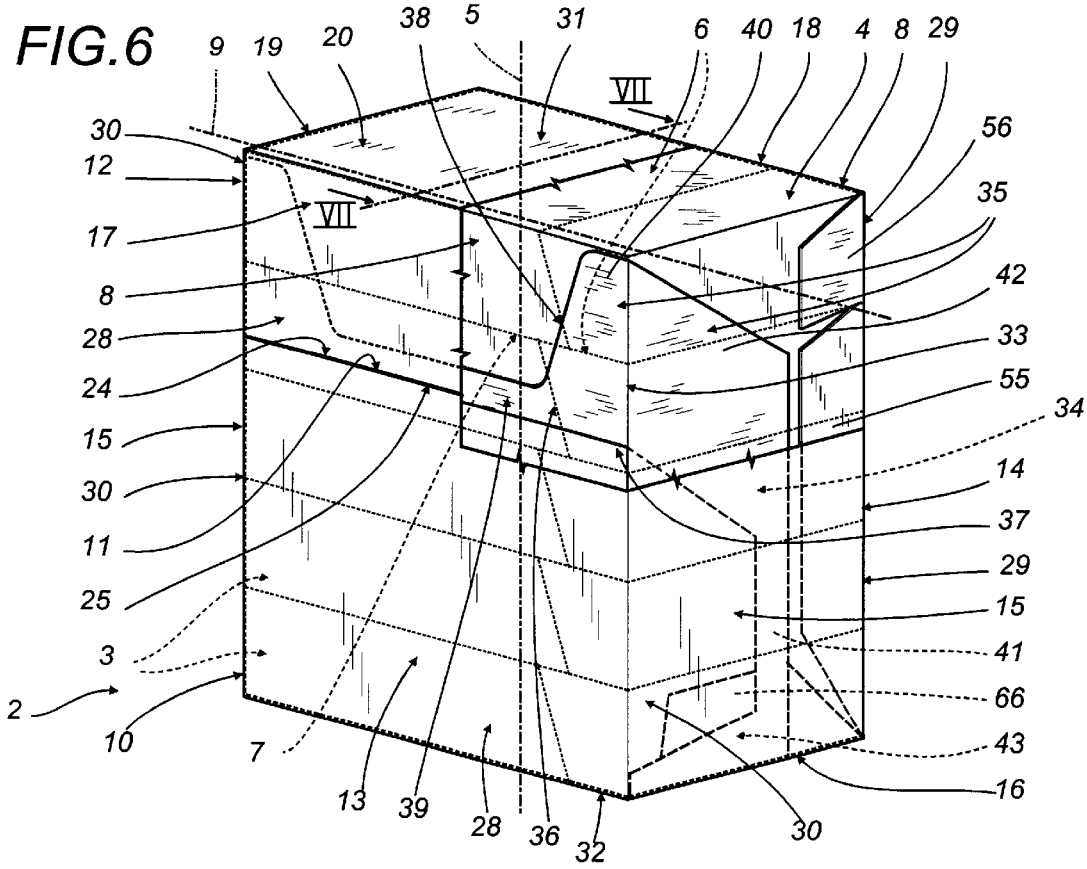
FIG. 6 illustrates a rigid package with hinged lid made from the blank illustrated in FIG. 5.

The blank 1 is used to make a rigid box-like package, illustrated in FIG. 6 and labeled 2 as a whole, designed to hold an ordered group 3 of cigarette packs 4 stacked along a given stacking axis 5. Each pack 4 is of the rigid hinged-lid type with a substantially parallelepiped shape comprising two larger side surfaces 6, 7 defining the front 6 and, respectively, the back 7, two smaller side surfaces 8 defining the sides 8, and a longitudinal axis 9 parallel with the surfaces 6, 7 and 8.

Figure 7:
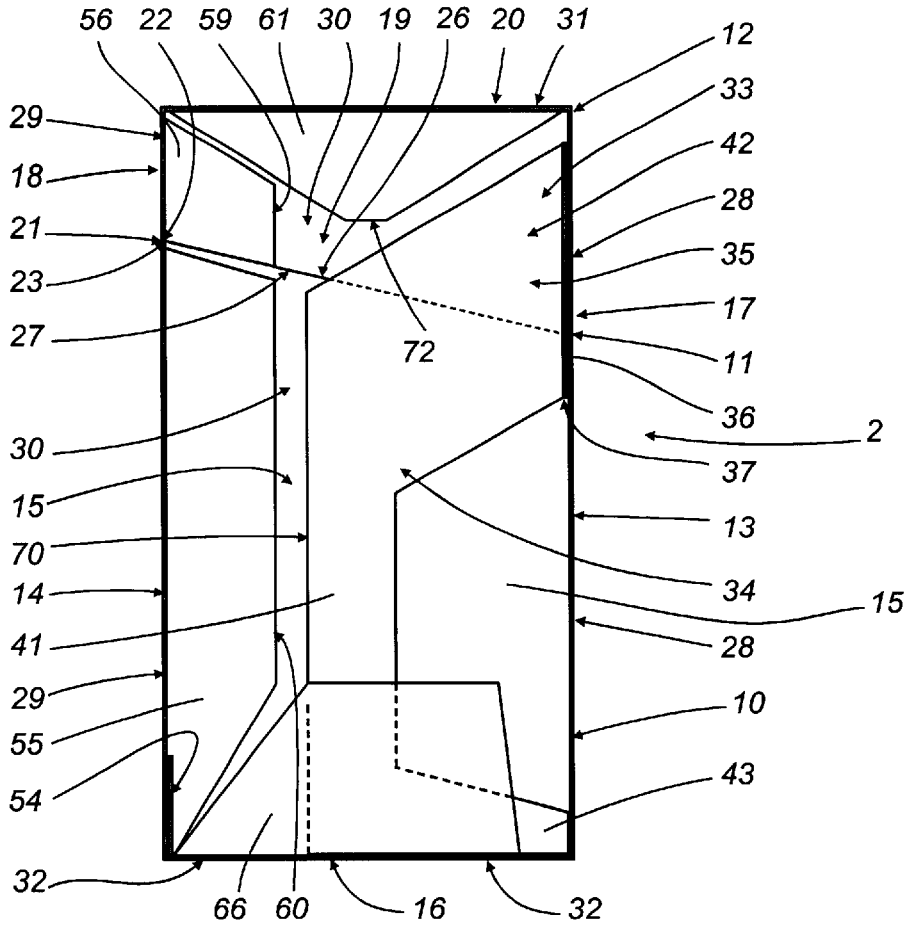
FIG. 7 is a longitudinal cross-section along line VII—VII of the package illustrated in FIG. 6.

As illustrated in FIGS. 6 and 7, the box-shaped package 2 has the shape of a rectangular parallelepiped and in turn comprises a lower, cup-shaped container 10 with an open top end 11, and an upper lid 12, also cup-shaped and hinged to the container 10 in such a way that it can turn between a position in which the end 11 is open (not illustrated) and a position in which it is closed.

The container 10 has a front surface 13 and a rear surface 14 which are opposite to and parallel with one another, two side surfaces 15 which are parallel with one another and perpendicular to the surfaces 13 and 14, and a bottom surface 16 which is perpendicular to the surfaces 13, 14 and 15.

The lid 12 has a front surface 17 and a rear surface 18 which are opposite and parallel with one another, two side surfaces 19 (only one of which is illustrated) which are parallel with each other and perpendicular to the surfaces 17 and 18, and a top surface 20 which is perpendicular to the surfaces 17, 18 and 19.

As is more clearly illustrated in FIG. 7, the rear surfaces 14 and 18 have edges 21 and 22 which are integral with one another and define a transversal hinge line 23 for rotation of the lid 12 between the above-mentioned open (not illustrated) and closed positions, whilst the front surfaces 13 and 17, as illustrated in FIG. 6, have free edges 24 and 25, and the side surfaces 15 and 19, as illustrated in FIG. 7, have free edges 26 and 27. With the lid 12 in the closed position, the edges 24, 25, 26 and 27 define an opening line for the lid 12 relative to the container 10.

The package 2 has a front 28 defined by the surfaces 13 and 17, a back 29 defined by the surfaces 14 and 18, two sides 30, parallel with one another and each defined by a respective surface 15 and 19, a top 31 defined by the surface 20 and a bottom 32 defined by the surface 16.

Finally, the package 2 comprises an inner frame 33, fixed to the container 10 and having a portion 34 which is inside the container 10 and a remaining portion 35 projecting from the container 10 from the end 11 and basically acting as a support and retaining element for the lid 12 when the latter is in the closed position.

The inner frame 33 comprises a central surface 36 which on the side of the surface 16 has a lower edge 37 which is opposite to and parallel with the surface 16 and, on the side of the lid 12, a substantially U-shaped upper edge 38 defining a lowered central portion 39 and two side tabs 40 extending towards the lid 12. The surface 36 is fixed to the inner surface of the surface 13, from which it projects with the tabs 40 and part of the portion 39, and is integral with two side surfaces 41 of the inner frame 33 fixed to the inner surface of the respective surfaces 15. The surfaces 41 have an end 42 which projects towards the lid 12 from the surface 15 and an end 43, opposite the end 42, extending to the bottom surface 16 of the container 10.

As already indicated at the beginning of the description, the container 10, lid 12 and inner frame 33 of the package 2 illustrated in FIGS. 6 and 7 are made by folding the blank 1, illustrated in FIG. 5, and for convenience, the parts of the blank 1 illustrated are, where possible, hereinafter referred to using reference numbers with an apostrophe identical to those used above to label the corresponding parts of the package 2.

As illustrated in FIG. 5, the blank 1 has a substantially rectangular shape, extending mainly along a substantially symmetrical longitudinal axis 44 and comprising, in the direction of the axis 44, a main portion 45 designed to define the container 10 and the lid 12, and a longitudinal end appendix 46, which extends longitudinally along the axis 44 of the blank 1 and is designed to define the inner frame 33. The appendix 46 is substantially U-shaped and is hinged to the portion 45 by its two arms 41' and along two side edges of a preweakened transversal fold line 47 which is at a right angle to the axis 44.

The blank 1 also has a plurality of preweakened transversal fold lines 48–51 which are parallel with the line 47 and two preweakened longitudinal fold lines 52 and 53 which are parallel with the axis 44. The lines 52 and 53 and the lines 48–51 together define the above-mentioned surfaces of the container 10, the lid 12 and the inner frame 33.

More specifically, the lines 47–51 define on the portion 45, and between the lines 52 and 53, an end panel 29' extending along the axis 44 on the opposite side to the appendix 46, starting from the line 49, a first intermediate panel 31' between line 49 and line 50, a central panel 28' between line 50 and line 47, a second intermediate panel 32' between line 47 and line 51, and a longitudinal end tab 54, extending between line 51 and its edge 37' parallel with line 51.

Line 48 defines the transversal hinge line 23 for rotation of the lid 12 and delimits and defines, on the panel 29', two portions 14' and 18', outside which lines 52 and 53 identify two respective pairs of tabs labeled first tabs 55 and second tabs 56.

Each tab 55 is trapezoidal in shape, with the larger base hinged to the portion 14' along the longitudinal fold line 52, 53 and is separated from the adjacent tab 56 by a substantially triangular oblique notch 57 and is delimited, on the side opposite the notch 57, by an edge 62 which is at an oblique angle to the axis 44.

Each tab 56 is substantially trapezoidal, with the larger base hinged to the portion 18' along the longitudinal fold line 52, 53 and, on the side opposite the notch 57, has an edge 58 at an oblique angle to the line 49 and delimited at the side by an edge 59 respectively aligned with each edge 60 of each tab 55.

At the outer edge of the panel 31', the longitudinal lines 52 and 53 also define a pair of third tabs 61, each hinged to the panel 31' along a hinge line 62 which is defined by the respective line 52, 53.

Each tab 61 is trapezoidal in shape and is separated from the adjacent tabs 56 and from two adjacent panels 30' on the opposite side to the tabs 56 along the longitudinal lines 52 and 53 by substantially triangular notches 63 and 64.

At the outer edge of the panel 28', the longitudinal lines 52 and 53 also define a pair of the side panels 30' which, together with the panel 28', are crossed from one side to the other by a precut transversal line 65 which defines the above-mentioned line at which the lid 12 opens relative to the container 10.

On the panel 28', the line 65 delimits and defines two rectangular portions 13' and 17', and on each panel 30', two trapezoidal portions 15' and 19'.

At the outer edge of the panel 32', the longitudinal lines 52 and 53 also define a pair of fourth side tabs 66 which are trapezoidal with the larger bases hinged along the lines 52 and, respectively 53. The appendix 46 has a continuous punched line 68 which begins at and returns to the transversal fold line 47 and defines not only the tabs 66, but also the above-mentioned tab 54, or fifth tab 54, which is hinged to the second intermediate panel 32' along the transversal fold line 51. The punched line 68 defines and delimits the outside of a free longitudinal end 67 of the main portion 45 hinged to the central panel 28' along the transversal fold line 47. The free end 67 is separate from the appendix 46 and consists of the panel 32', the tabs 66 and the tab 54.

The appendix 46 surrounds the edge of the end 67 along the punched line 68 and is connected to the panels 30' along the line 47 with its two side arms 41', which are defined by the lines 52 and 53 on the outside of a transversal panel 36', defining a longitudinal end of the blank 1 which defines the central surface 36 of the inner frame 33 of the package 2 illustrated in FIG. 6.

In particular, as illustrated in FIG. 5, on the side opposite the tab 54, the panel 36' has a substantially U-shaped edge 38', defining a lowered central portion 39' parallel with the preweakened transversal fold lines 48–51, and therefore is perpendicular to the axis 44 of the blank 1. The edge 38' also defines two side tabs 40' extending towards the exterior of the blank 1 and substantially parallel with the axis 44.

On the opposite side to the respective panel 30', each arm 41' is delimited by an oblique edge 69 which ends at the tabs 40'. The arms 41', panels 30', tabs 55 and the tabs 61 are laterally delimited by respective edges 70, 71, 60 and 72 which are parallel with the axis 44 of the blank 1. Edges 60 and 72 are also aligned with the above-mentioned edges 59 of the tabs 56.

The arms 41' are substantially equal in length to the panels 30' and, without the portion surrounding the respective tab 66, their width is substantially equal to the difference between the width of the panels 30' and the width of the tabs 55.

The appendix 46 is designed to be folded over the portion 45 along the line 47 and fixed to the surfaces of the portions 13' and 15' which are designed to face inside the package 2.

Each tab 55, together with the respective tab 56, and each assembly consisting of a panel 30' and the relative arm 41' folded and fixed to the portion 15' are designed to be folded at right angles to the panels 29' and respectively 28' and to overlap one another, by rotating the panels 28' and 29' at right angles to one another relative to the panel 31'. The tabs 61 are designed to be folded at right angles to the panel 31' so that they make contact with the inner surfaces of the portions 19'.

Finally, the panel 32' is designed to be folded at right angles to the panel 28' to define the bottom 32 of the package 2, whilst the tab 54 and each tab 66 are designed to be folded at right angles to the panel 32', and to be rotated with the panel 32' so that they come into contact with the inner surface of the portion 14' of the panel 29' and, respectively, the inner surface of the corresponding arm 41', thus defining flaps for closing the bottom 32.

The blank 1 is obtained, with obvious economic advantages, from a relatively short length of web (not illustrated) . This is basically due to the fact that the bottom 32 and relative closing flaps are obtained from the same longitudinal portion of the above-mentioned length of web (not illustrated) from which the inner frame 33 is obtained.

As illustrated in FIG. 6, the rigid package 2 obtained from the blank 1 contains a group 3 of ordered cigarette packs 4 stacked along the stacking axis 5 and laid flat against one another with the front 6 of one pack in contact with the back 7 of the next, and with their longitudinal axes 9 parallel with one another and perpendicular to the stacking axis 5 and parallel with both the lowered central portion 39 of the central surface 36 of the inner frame 33 and the bottom 32 of the container 10.

As illustrated in FIG. 7, the tabs 55, 56 and 61 and the tabs 66 are of a shape and size such that, on the completed package 2, the tabs 55 and the tabs 66 on one side, and the tabs 56 and 61 on the other, are opposite one another but not overlapping. Moreover, again as illustrated in FIG. 7, the tabs 56 and 61 and the arms 41 are of a size and shape such that, to define the respective surfaces 19, the tabs 56 and 61 overlap the portions 19' without interfering with the arms 41'.

Figure 8:
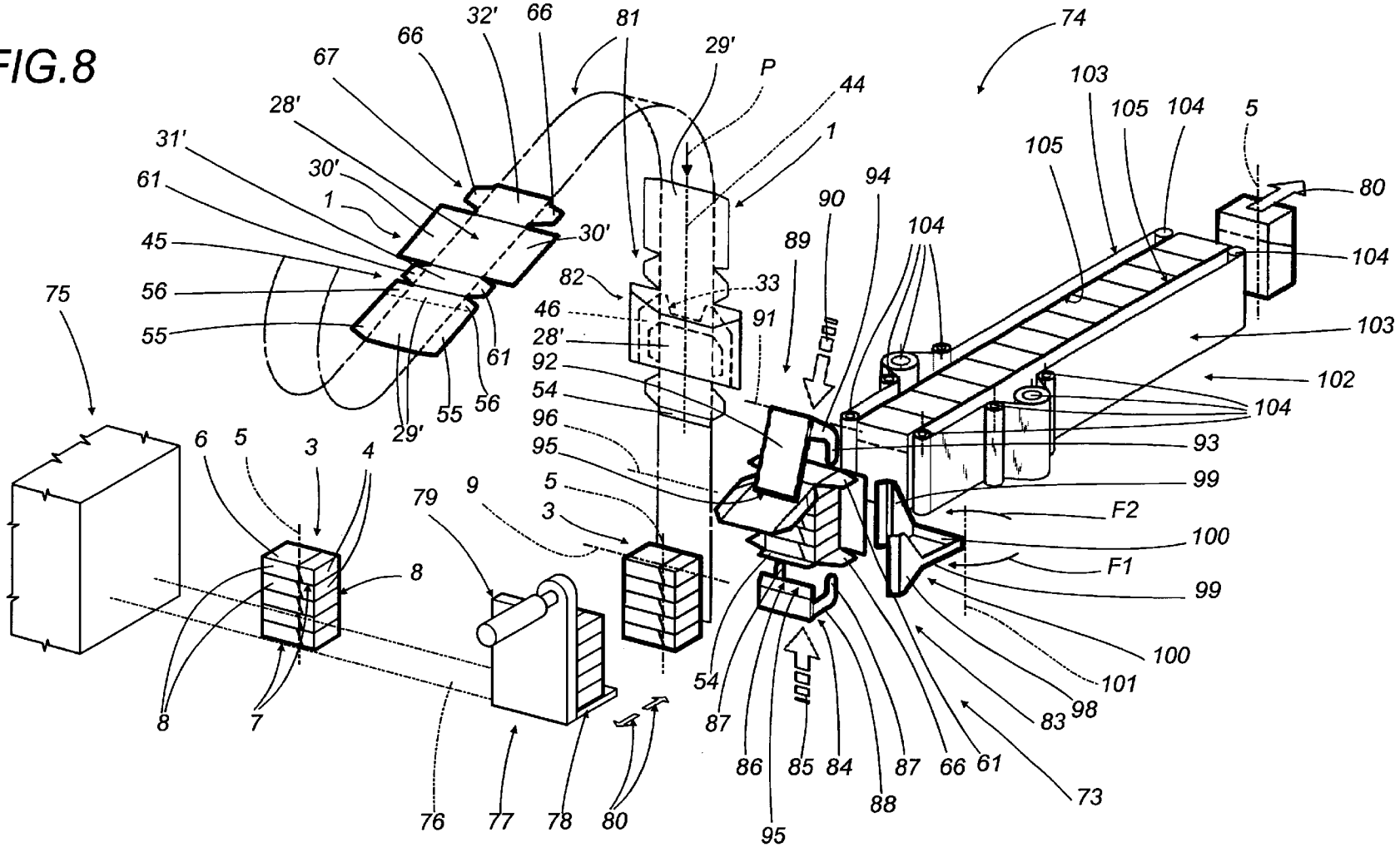
FIG. 8 is a schematic perspective view of a first embodiment of a packaging station on a cartoner for making the package illustrated in FIG. 6.

In FIG. 8 the numeral 73 indicates as a whole a packaging station in a portion 74 of a cartoner of the known type. The packaging station 73 is connected to a forming unit 75 (of the known type and schematically illustrated as a block) for ordered groups 3 of cigarette packs 4 stacked flat one against the other along a given stacking axis 5. Each pack 4 is of the rigid hinged-lid type and substantially has the shape of a parallelepiped comprising two larger side surfaces 6, 7 defining the front 6 and, respectively, the back 7, two smaller side surfaces 8 defining the sides 8, and a longitudinal axis 9 parallel with the surfaces 6, 7 and 8. The groups 3 are fed from the unit 75 along a feed line 76 and move towards a pusher 77 with a lower surface 78 designed to support each group 3, with the surface 7 of the lower pack 4 in contact with the surface 78, and a side surface 79 perpendicular to the lower surface 78 and designed to make contact with the sides 8 of the packs 4 forming the group 3 and to push the group 3 in a direction of feed 80 which is at a right angle to the line 76 and the stacking axis 5.

In addition to the unit 75, the portion 74 of the cartoner comprises a blank 1 feed line 81, the end 82 of which extends along a blank 1 feed path P between the pusher 77 and the packaging station 73.

In particular, the path P lies on a plane which is at a right angle to the direction 80 and is between the pusher 77 and a folding unit 83 in front of which each blank 1 is positioned in such a way that it intercepts each group 3 of packs 4 which the pusher 77 pushes towards the folding unit 83.

The blank 1 travels along the path P with its longer longitudinal axis 44 parallel with the stacking axis 5, with the end panel 29' facing upwards and the appendix 46 folded so that it makes contact with the central panel 28' and the side panels 30'. The pusher 77 and the line 81 are synchronized in such a way that, when the group 3 has moved in the direction 80, the blank 1 is intercepted by the group 3, which is arranged with the smaller side surfaces 8 or sides 8 of the packs 4 in contact with the inner surface of the central panel 28' and with the appendix 46, which is between the sides 8 of the packs 4 and the inner surface of the panel 28'.

The unit 83 comprises a first, lower folder 84, with alternating movements in a direction 85 orthogonal to the direction 80, between a lowered home position (as illustrated in FIG. 8) and a raised folding position. It has a first folding end 86 designed to fold the fifth longitudinal end tab 54 so that it makes contact with the group 3 and is parallel with the sides 8 of the packs 4. The folder 84 also comprises a pair of second ends 87 located on opposite sides of the end 86 and designed to simultaneously intercept and fold the fourth tabs 66 so that they make contact with the group 3 and are at a right angle to the central panel 28' of the blank 1. The projections 87 are supported by respective arms 88 which extend at right angles from the end 86.

The unit 83 also comprises a second, upper folder 89, with a first alternating movement in a direction 90 which is inclined relative to the direction 85 and transversal to the direction 80, between a raised home position and a lowered folding position, and a second oscillating movement about an axis of rotation 91 which is substantially parallel with the axis 9 of each pack 4. The second folder 89 has a first folding end 92 designed to fold the end panel 29' of the blank 1 so that it makes contact with the group 3 and with the fifth tab 54. The panel 29' is folded by the end 92 following its descent towards its lowered folding position and simultaneous oscillation about the axis 91 towards the group 3.

The folder 89 also comprises a pair of second ends 93 (only one of which is visible in FIG. 8) located on opposite sides of the end 92 and designed to simultaneously intercept and fold the third tabs 61 so that they make contact with the group 3 and are at a right angle to the central panel 28' and the intermediate panel 31' of the blank 1. The ends 93, like the ends 87, are supported by arms 94 which extend at right angles from the end 92.

When the folder 84 and the folder 89 are in their home positions their ends 86 and 92 define fixed contact means 95, designed to intercept the blank 1 as it is fed into the folding unit 83 following the thrust applied by the group 3 as it is fed along the direction 80, and to fold the blank 1 into a U shape around the lines 47 and 50 and around an axis 96 which is at a right angle to the group 3 stacking axis 5, the longitudinal axis 44 and the path P.

In this way, the fixed contact means 95 are designed to bring the first intermediate panel 31' and the second intermediate panel 32' into contact with the larger surface 6 of the upper pack 4 in the group 3 and, respectively, with the larger surface 7 of the lower pack 4 in the group 3.

The unit 83 also comprises a pair of third side folders 97 (only one of which is visible in FIG. 8), which are positioned on opposite sides of the folders 84 and 89. Each folder 97 comprises a first folding end 98 designed to bring the first and second tab 55, 56 into contact with the group 3 and at a right angle to the central panel 28', and a second folding end 99 designed to turn the panel 30' and arm 41' towards the group 3, so that the panel 30' and arm 41' are at a right angle to the central panel 28', with the arm 41' partially in contact with the group 3.

The rotation of the transversal side panels 30', together with the arms 41' towards the group 3, causes the panels 30' to overlap the first, second and third transversal tabs 55, 56, 61, previously folded.

The free end of the end 98 and 99 of each folder 97 is supported by a pair of arms 100, at an angle to one another and converging at a point at which they are joined and rotate about an axis 101 parallel with the group 3 stacking axis 5.

Each folder 97 therefore constitutes a rocker arm which can oscillate about the axis 101 in such a way that it alternately intercepts the tabs 55 and 56 and the panels 30', moving between a first folding position reached by rotating about the axis 101 clockwise as indicated by the arrow F1, at which it simultaneously intercepts and folds the tabs 55 and 56, and a second folding position reached by rotating anti-clockwise about the axis 101 as indicated by the arrow F2, at which it intercepts and folds the panels 30', bringing them into contact with the tabs 55 and 56, 61 and 66, thus completing formation of the package 2.

It should be noticed that the packaging station 73 also comprises a plurality of gumming units, of the known type and therefore not illustrated, designed to apply a layer of adhesive material to the tabs 55, 56, 61, 66 and 54 to stably seal the package 2.

Downstream of the packaging station 73, the above-mentioned portion 74 comprises an outfeed channel 102 for the completed packages 2.

The channel 102 extends longitudinally in the direction 80 and consists of a pair of lateral conveyors 103 which are closed in a loop around pulleys 104 whose axes are parallel with the stacking axis 5. On the conveyors 103, the pulleys 104 define two operating branches 105, separated by a length that is substantially equal to the width of the package 2 measured along the axis 9 of the packs 4, so that the sides 30 of the packages 2 can be completely stabilized as the packages 2 are fed along the channel 102.

What is claimed is:

1. A blank made of a wrapping material for making a rigid package with hinged lid for an ordered group of cigarette packs, the rigid package having a front, a back, two sides, a top and a bottom, and comprising a container and a lid, both cup-shaped and hinged together along respective rear edges, and an inner frame which is partially inside the container and fixed to a front surface and two sides of the container; the flat blank having a main portion designed to define the container and lid, and an appendix at one end which is substantially U-shaped and comprises two side arms and a transversal panel, being designed to define the inner frame; wherein the blank is substantially rectangular, with a longer longitudinal axis and, extending along the longitudinal axis, comprises the above-mentioned main portion and appendix; the main portion comprising an end panel designed to define the back, a first intermediate panel designed to define the top, a central panel designed to define the front and two side panels designed to define the sides; the appendix being hinged with the arms to the respective side panels and surrounding a longitudinal free end of the main portion; the free end comprising a second intermediate panel designed to define the bottom, two transversal fourth side tabs and a fifth longitudinal end tab designed to define respective flaps for closing the bottom.

2. The blank according to claim 1, wherein the two arms of the appendix and the second intermediate panel are hinged along a shared preweakened transversal fold line to the side panels and, respectively, to the central panel.

3. The blank according to claim 1, wherein the appendix and the free end are separated by a shared continuous punched line.

4. The blank according to any of the for going claim 1, comprising two preweakened longitudinal fold lines separating the central panel from the side panels, the second intermediate panel from the fourth side tabs and the arms from the transversal panel; the two longitudinal fold lines defining a pair of first and second side tabs extending on both sides on the outside of the end panel.

5. The blank according to claim 4, wherein the width of the side panels is substantially equal to the width of the sides and is substantially equal to the sum of the widths of the first side tabs and the arms.

6. The blank according to claim 5, wherein the two longitudinal fold lines define a pair of third side tabs on the outside of the first intermediate panel; the first, second and third side tabs and the arms being shaped in such a way that they are positioned side-by-side without reciprocal interference once they are overlapping the side panels.

7. The blank according to any of the claim 1, comprising a precut transversal line at the central panel and side panels, said precut transversal line crossing the blank from one side to the other and being designed to define a line at which the lid opens relative to the container.

8. The blank according to any of the claim 1, wherein the transversal panel defines a central portion of the inner frame.

9. The blank according to any of the claim 1, wherein the longitudinal axis is an axis of symmetry.

10. A method for making a rigid package with hinged lid for an ordered group of cigarette packs stacked along a given stacking axis, each pack having a substantially parallelepiped shape comprising two larger side surfaces, two smaller side surfaces and a longitudinal axis parallel with the surfaces, the packs being stacked flat, with their longitudinal axes parallel with one another and perpendicular to the stacking axis; the shape of the package being substantially that of a parallelepiped, defined by a front, a back, two sides, a top and bottom and comprising a container and a lid, both cup-shaped and hinged together along rear edges, and an inner frame which is partially inside the container and fixed to a front surface and two sides of the container; the package being made from a flat blank which has a main portion designed to define the container and lid, and a substantially U-shaped appendix comprising two side arms and a transversal panel designed to define the inner frame; the method comprising the stages of feeding the blank, with substantially rectangular shape and a longitudinal axis extending in the direction of the main portion and appendix, along a given feed path and in a direction parallel with the longitudinal axis, and parallel with the pack stacking axis, towards a folding unit; positioning the blank at a given point between the group of packs and the folding unit; the main portion comprising an end panel designed to define the back, a first intermediate panel designed to define the top, a central panel designed to define the front, and two side panels designed to define the sides, the appendix being hinged with the arms, which extend parallel with the longitudinal axis, to the side panels, and making contact with the main portion from a position in which it surrounds a longitudinal free end of the main portion, the free end comprising a second intermediate panel designed to define the bottom, two transversal fourth side tabs and a fifth longitudinal end tab designed to respectively define the flaps for closing the bottom; in the given position, the appendix having the arms parallel with the stacking axis and the transversal panel being perpendicular to the stacking axis; feeding the group of packs in a direction substantially at right angles to the stacking axis and with the smaller side surfaces facing the blank; wrapping the blank around the group of packs, folding it about an axis at right angles to both the stacking axis and the longer longitudinal axis of the blank.

11. The method according to claim 10, wherein the stage of wrapping the blank around each group of packs comprises stages of arranging the smaller side surfaces of the packs forming the group so that they are in contact with the inner surface of the central panel, with the appendix between the sides and the inner surface.

12. The method according to claim 11, wherein the stage of wrapping the blank comprises stages of bringing the first and second intermediate panel into contact with the larger side surface of the packs at the end of the group.

13. The method according to claim 12, wherein the stage of wrapping the blank comprises the stage of bringing at least the fifth longitudinal end tab into contact with the group and parallel with the smaller side surfaces of the packs.

14. The method according to claim 13, wherein the stage of wrapping the blank comprises the stage of bringing at least the two fourth transversal side tabs into contact with, the group and at a right angle to the central panel.

15. The method according to claim 13 or 14, wherein the stage of wrapping the blank comprises the stage of bringing the end panel into contact with the group and with the fifth longitudinal end tab.

16. The method according to claim 15, wherein the blank has a pair of first and second tabs extending transversally to the end panel on opposite sides of the longitudinal axis of the blank and a pair of third tabs extending transversally to the first intermediate panel on opposite sides of the axis; and wherein the stage of wrapping the blank comprises the stage of bringing at least one of the two third transversal side tabs into contact with the group and at a right angle to the central panel.

17. The method according to claim 16, wherein the stage of wrapping the blank comprises the stage of bringing at least one of the two first and second transversal side tabs into contact with the group and at a right angle to the central panel.

18. The method according to claim 17, wherein the stage of wrapping the blank comprises the stage of rotating at least one of the transversal side panels, together with the arm of the appendix, towards the group, so as to position the side panel and arm at a right angle to the central panel, at least the arm being partially in contact with the group.

19. The method according to claim 13, wherein the stage of rotating at least one of the transversal side panels, together with the arm of the appendix, towards the group causes the transversal side panels to overlap the first, second and third transversal tabs.

20. The method according to claim 13, wherein the stage of bringing at least the fifth longitudinal end tab into contact with the group and parallel with the smaller side surfaces of the packs and the stage of bringing at least one of the two fourth transversal side tabs into contact with the group and at a right angle to the central panel are carried out simultaneously by the same first folder in the folding unit.

21. The method according to claim 15, wherein the stage of bringing the end panel into contact with the group and the stage of bringing at least one of the third transversal side tabs into contact with the group and at a right angle to the central panel are carried out simultaneously by the same second folder in the folding unit.

22. The method according to claim 17, wherein, in order to define each of the two sides of the rigid package, the stage of bringing at least one of the two first and second transversal side tabs into contact with the group and at a right angle to the central panel and the stage of rotating at least one of the transversal side panels, together with the arm of the appendix, towards the group, are carried out in succession by the same third folder in the folding unit.

* * * * *